US005593377A

United States Patent [19]

Figgener et al.

[11] Patent Number: 5,593,377

[45] Date of Patent: Jan. 14, 1997

[54] WEIR AND CHOKE PLATE FOR A SOLID-JACKET CENTRIFUGE DRUM

[75] Inventors: Helmut Figgener; Paul Bruning, both of Oelde, Germany

[73] Assignee: Westfalia Separator Aktiengesellschaft, Oelde, Germany

[21] Appl. No.: 446,877

[22] PCT Filed: Apr. 30, 1994

[86] PCT No.: PCT/EP94/01380

§ 371 Date: May 26, 1995

§ 102(e) Date: May 26, 1995

[87] PCT Pub. No.: WO95/00249

PCT Pub. Date: Jan. 3, 1995

[30] Foreign Application Priority Data

Jun. 18, 1993 [DE] Germany ..... 43 20 265.9

[51] Int. Cl.[6] ..... B04B 1/20; B04B 11/00

[52] U.S. Cl. ..... 494/56; 494/53

[58] Field of Search ..... 494/52–54, 56, 494/57, 85; 210/380.1, 380.3

[56] References Cited

U.S. PATENT DOCUMENTS

| | | | |
|---|---|---|---|
| 3,580,492 | 5/1971 | Schnittger et al. | 494/57 X |
| 4,575,370 | 3/1986 | LaMontagne | 494/56 |
| 4,764,163 | 8/1988 | Caldwell | 494/56 |
| 4,950,219 | 8/1990 | Luchetta | 494/56 X |
| 5,169,377 | 12/1992 | Schlip et al. | 494/56 |
| 5,217,428 | 6/1993 | Schlip et al. | 494/53 X |

FOREIGN PATENT DOCUMENTS

| | | |
|---|---|---|
| 391043 | 10/1990 | European Pat. Off. . |
| 3921327 | 1/1991 | Germany . |
| 57-194061 | 11/1982 | Japan . |

*Primary Examiner*—Charles E. Cooley
*Attorney, Agent, or Firm*—Sprung Horn Kramer & Woods

[57] ABSTRACT

In a solid-jacket centrifuge drum for separating out a liquid phase, a weir is rotatable with the drum around an axis, is disposed in a path of the separated out liquid phase and has at least one channel for the separated out liquid phase. A choke plate regulates flow through the at least one channel in the weir and thereby the level of liquid inside the drum. The choke plate is stationary relative to the rotation of the weir and the drum and is axially displaceable relative to the weir to form a gap therebetween for the separated out liquid phase. The gap has a distance which is varied with the axial displacement of the choke plate.

5 Claims, 2 Drawing Sheets

WEIR AND CHOKE PLATE FOR A SOLID-JACKET CENTRIFUGE DRUM

BACKGROUND OF THE INVENTION

The present invention concerns a weir for a solid-jacket centrifuge drum. The weir includes at least one channel for releasing a liquid phase that has been separated out inside the drum. A choke plate travels back and forth axially and is associated with the weir.

A weir of this type is known for example from Japanese 57-194 061 A2. The weir is intended to regulate the flow of solids out of the drum to maintain a particular concentration thereof. The weir rotates along with the drum and is connected at a bearing site to a stationary component that can be axially displaced. The bearing site must be sealed off from the escaping liquid phase. Designs of this type are complex and likely to malfunction.

Another weir is known from German 4 132 029 A1. It has a spinning chamber that varies the diameter of the weir between two different values. This approach makes it possible to adjust the level of liquid at start-up to prevent the liquid from surging over to the solids side.

It is, however, frequently desirable to continuously vary the level of liquid in the drum in order to optimize clarification and separation. German 3 921 327 A1 proposes various ways of doing so by varying the diameter of the aperture at the weir. The necessary components require transmission of the adjusting forces to rotating components, and the requisite transmission components can be sensitive to malfunction.

SUMMARY OF THE INVENTION

The object of the present invention is accordingly a weir that will allow continuous variation of the level of liquid in the drum without requiring the transmission of adjusting forces to rotating parts.

This object is attained in accordance with the present invention in that the choke plate is stationary and positioned at the channel that the clarified liquid phase travels through, so that the level of liquid inside the drum can be varied by axially displacing the plate.

It has surprisingly been demonstrated that a stationary plate is in no way detrimental to the drum's function. The expected deceleration due to liquid passing through the annular gap between the rotating weir and the stationary plate does not occur. The gap constitutes an impedance that increases as the axial distance between the weir and the plate decreases. As the impedance increases, however, the pressure of the liquid at the channel must increase in order to raise the level of the liquid in the drum. As the distance between the weir and the plate increases, the level of liquid in the drum will drop until it can regulate the flow through the weir in the regular way.

One practical way of axially displacing the plate is with a hydraulic, pneumatic, or mechanical transmission. The last mentioned can for example include a threaded sleeve.

The channel in another advantageous embodiment comprises several grooves extending out from the inside diameter of the weir. The shape of the grooves determines the length of the edge the liquid weirs over. The diameter of the outflow cross-section through which the liquid flows out of the drum is the product of the active length of the edge and distance between the weir and the plate.

The channel in still another advantageous embodiment comprises several round, rectangular, or square orifices in the wall of the weir.

One embodiment of the present invention will now be specified with reference to the accompanying drawings.

DETAILED DESCRIPTION OF THE INVENTION

Figure 1:
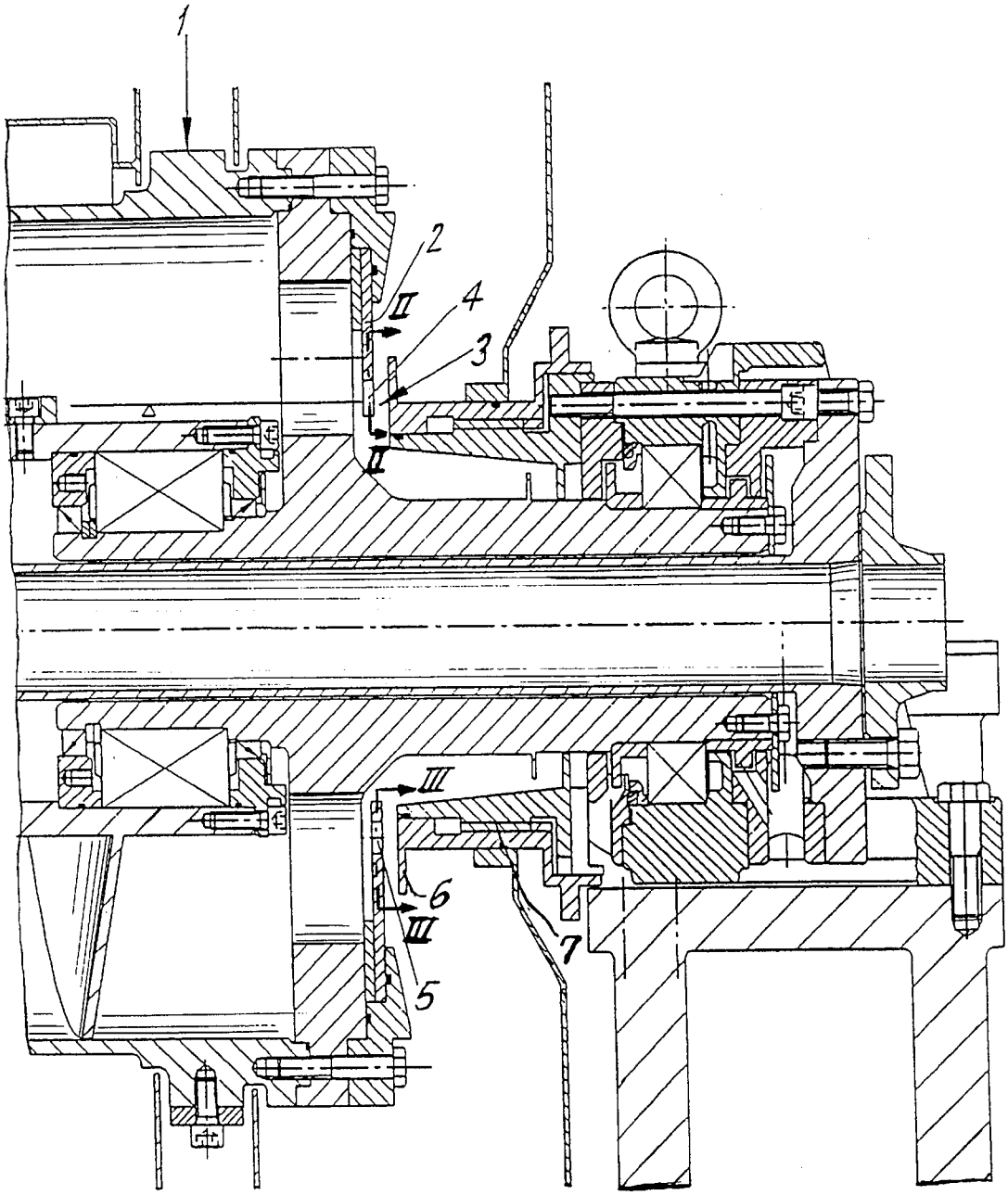
FIG. 1 is a sectional view of a centrifuge according to the present invention.
Figure 2:
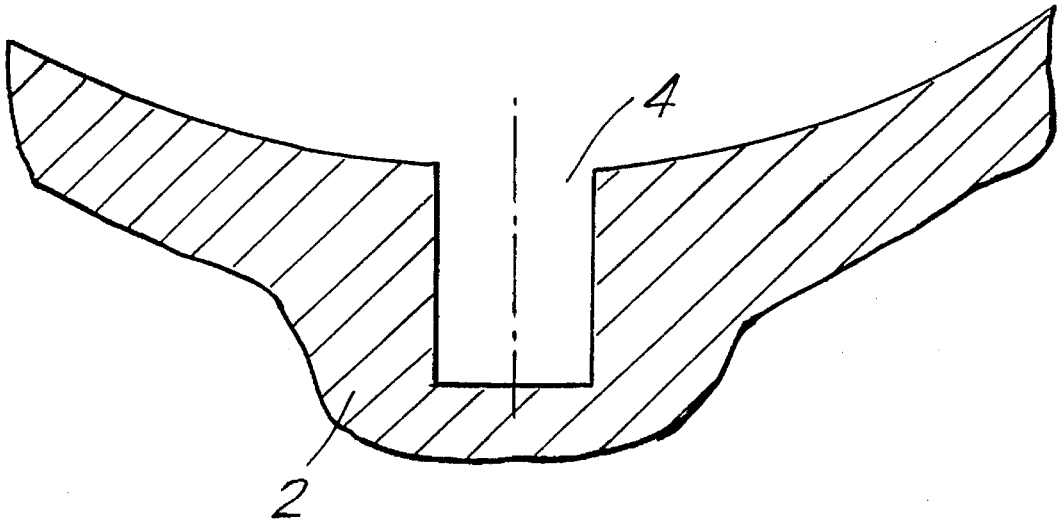
FIG. 2 is a sectional view of a detail along line II—II in FIG. 1.
Figure 3:
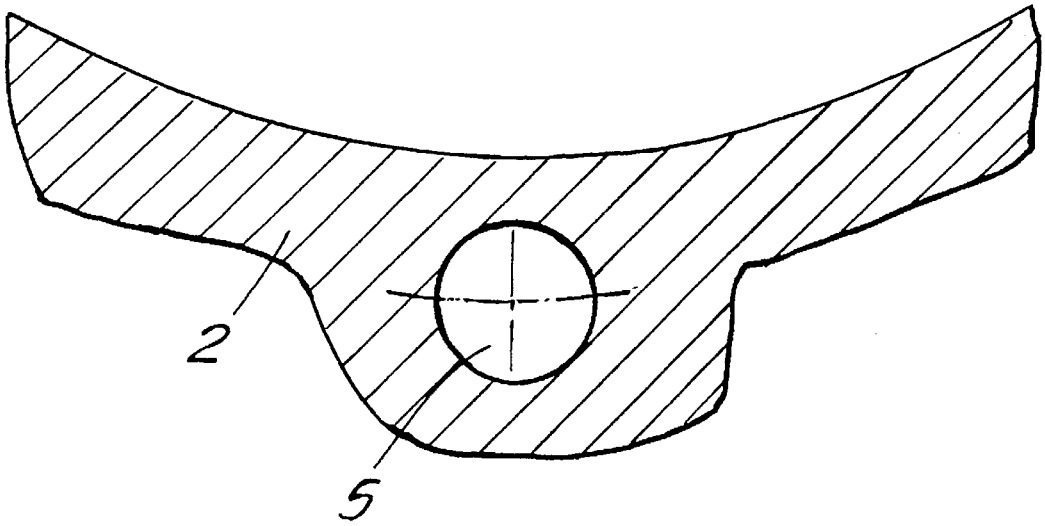
FIG. 3 is a sectional view of a detail along line III—III in FIG. 1.

As can be seen from FIGS. 1–3, a centrifuge drum 1 has a weir 2 at the liquid-outlet end. Weir 2 is provided with a channel 3. Channel 3 comprises either several grooves 4 extending out of the inside diameter of the weir or several orifices 5 through the wall of the weir. Associated with channel 3 is a stationary plate 6 that can be axially displaced by a threaded sleeve 7.

The distance between weir 2 and plate 6 can be varied by rotating sleeve 7. Varying the distance varies the width of the outflow cross-section through which the liquid flows out of drum 1, which is constituted by that distance and by the overall length of the edge the liquid weirs over. Varying the width of the outflow cross-section varies the level of liquid in drum 1, allowing continuous adjustment of that level by displacing plate

What is claimed is:

1. In a solid-jacket centrifuge drum for separating out a liquid phase, a weir rotatable with the drum around an axis and disposed in a path of the separated out liquid phase and having at least one channel for the separated out liquid phase and a choke plate for regulating flow through the at least one channel in the weir and thereby the level of liquid inside the drum, wherein the choke plate is stationary relative to the rotation of the weir and the drum and is axially displaceable relative to the weir to form a gap therebetween through which the separated out liquid phase passes, the gap having a distance which is varied with the axial displacement of the choke plate.

2. The centrifuge drum according to claim 1, wherein the choke plate is axially displaced by a threaded sleeve.

3. The centrifuge drum according to claim 1, wherein the at least one channel comprises grooves extending out from an inside diameter of the weir.

4. The centrifuge drum according to claim 1, wherein the at least one channel comprises orifices in a wall of the weir.

5. The centrifuge drum according to claim 4, wherein the orifices are round.

* * * * *